US009247604B2

(12) United States Patent
Nishi et al.

(10) Patent No.: US 9,247,604 B2
(45) Date of Patent: Jan. 26, 2016

(54) LIGHTING DEVICE

(71) Applicants: Sayaka Nishi, Osaka (JP); Takashi Saito, Osaka (JP); Hiroki Noguchi, Hyogo (JP); Naohiro Toda, Osaka (JP); Ayako Tsukitani, Kyoto (JP); Kensuke Yamazoe, Osaka (JP); Toshihide Mori, Osaka (JP); Hiroshi Hamano, Hyogo (JP); Kouichi Wada, Osaka (JP); Yoshinori Karasawa, Osaka (JP)

(72) Inventors: Sayaka Nishi, Osaka (JP); Takashi Saito, Osaka (JP); Hiroki Noguchi, Hyogo (JP); Naohiro Toda, Osaka (JP); Ayako Tsukitani, Kyoto (JP); Kensuke Yamazoe, Osaka (JP); Toshihide Mori, Osaka (JP); Hiroshi Hamano, Hyogo (JP); Kouichi Wada, Osaka (JP); Yoshinori Karasawa, Osaka (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 238 days.

(21) Appl. No.: 13/911,416

(22) Filed: Jun. 6, 2013

(65) Prior Publication Data

US 2014/0015442 A1 Jan. 16, 2014

(30) Foreign Application Priority Data

Jul. 13, 2012 (JP) ..... 2012-157686

(51) Int. Cl.
*H05B 35/00* (2006.01)
*H05B 33/08* (2006.01)

(52) U.S. Cl.
CPC ..... *H05B 33/0848* (2013.01); *H05B 33/0806* (2013.01); *H05B 33/0872* (2013.01); *H05B 33/0875* (2013.01); *H05B 35/00* (2013.01)

(58) Field of Classification Search
CPC ..... H05B 33/0848; H05B 33/0845; H05B 33/0854; H05B 33/0869; H05B 33/0857; H05B 33/0875; H05B 33/0878; H05B 33/0806; H05B 33/0833; H05B 33/0872; H05B 35/00
See application file for complete search history.

(56) References Cited

U.S. PATENT DOCUMENTS

| | | | | |
|---|---|---|---|---|
| 5,015,924 | A * | 5/1991 | Berman et al. | 315/324 |
| 7,008,078 | B2 * | 3/2006 | Shimizu et al. | 362/231 |
| 7,365,485 | B2 * | 4/2008 | Fukasawa et al. | 313/502 |
| 2002/0070681 | A1 | 6/2002 | Shimizu et al. | |
| 2005/0082974 | A1 | 4/2005 | Fukasawa et al. | |
| 2006/0050256 | A1 | 3/2006 | Takamura | |
| 2006/0149607 | A1 * | 7/2006 | Sayers et al. | 705/7 |
| 2010/0264432 | A1 | 10/2010 | Liu et al. | |
| 2010/0277097 | A1 * | 11/2010 | Maxik | 315/294 |
| 2011/0084616 | A1 | 4/2011 | Negley et al. | |

(Continued)

FOREIGN PATENT DOCUMENTS

| | | |
|---|---|---|
| CN | 201221693 | 4/2009 |
| CN | 201242128 | 5/2009 |
| EP | 1160883 | 12/2001 |
| JP | 2005-11812 | 1/2005 |
| JP | 3159820 | 5/2010 |

OTHER PUBLICATIONS

Search report from E.P.O., mail date is Jul. 30, 2014.

(Continued)

*Primary Examiner* — Jung Kim
(74) *Attorney, Agent, or Firm* — Greenblum & Bernstein, P.L.C.

(57) ABSTRACT

A lighting device is provided with an illumination unit including two or less LED light sources. The illumination unit uses the two or less LED light sources to emit light of a short wavelength band and light of a long wavelength band. An output varying unit functions to vary an output of at least the long wavelength band light. When the output varying unit receives a varying signal, the output varying unit functions to decrease the output of at least the long wavelength band light.

5 Claims, 6 Drawing Sheets

(56) References Cited

U.S. PATENT DOCUMENTS

| | | | | |
|---|---|---|---|---|
| 2012/0306382 | A1* | 12/2012 | Maxik et al. | 315/152 |
| 2013/0093331 | A1* | 4/2013 | Lin et al. | 315/152 |
| 2014/0015444 | A1* | 1/2014 | Saito et al. | 315/297 |

OTHER PUBLICATIONS

China Office action, dated Dec. 11, 2014 along with an English translation thereof.

* cited by examiner

LIGHTING DEVICE

CROSS-REFERENCE TO RELATED APPLICATIONS

This application is based upon and claims the benefit of priority from prior Japanese Patent Application No. 2012-157686, filed on Jul. 13, 2012, the entire contents of which are incorporated herein by reference.

BACKGROUND OF THE INVENTION

The present invention relates to a lighting device.

Japanese Utility Model No. 3159820 describes an example of a lighting device including a main power supply and a backup power supply. When the supply of power from the main power supply to a light source is interrupted, the light source is supplied with power from the backup power supply.

The lighting device of Japanese Utility Model No. 3159820 further includes a main light source and a backup light source. The backup light source is formed by an LED. When an abnormality occurs, the low power consumption backup (LED) light source is used so that the backup power supply, which is a rechargeable battery (battery cell), may be used for a relatively long time.

There is a demand for a lighting device that improves visibility under a mesopic vision environment. Japanese Laid-Open Patent Publication No. 2005-11812 discloses a lighting device that uses three LED light sources having different wavelengths and executes spectral control to generate light in accordance with a mesopic vision environment. Further, the lighting device of Japanese Laid-Open Patent Publication No. 2005-11812 uses LED light sources, and thus, consumes less power than fluorescent lamps and incandescent light bulbs.

Such a lighting device uses three types of LED light sources having different wavelengths to improve visibility under a mesopic vision environment. The LED light sources increase the number of components.

SUMMARY OF THE INVENTION

One aspect of the present invention is a lighting device provided with an illumination unit including two or less LED light sources. The illumination unit uses the two or less LED light sources to emit light of a short wavelength band and light of a long wavelength band. An output varying unit functions to vary an output of at least the long wavelength band light. When the output varying unit receives a varying signal, the output varying unit functions to decrease the output of at least the long wavelength band light.

Other aspects and advantages of the present invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which.

DETAILED DESCRIPTION OF THE INVENTION

A lighting device 10 according to one embodiment of the present invention will now be described with reference to the drawings.

Figure 1:
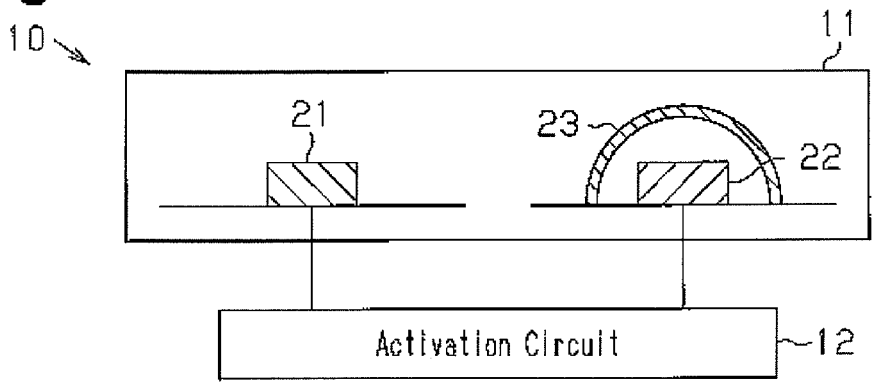
FIG. 1 is a schematic diagram showing one embodiment of a lighting device.

As shown in FIG. 1, the lighting device 10 of the present embodiment includes an illumination unit 11 and an activation circuit 12. The illumination unit 11 externally emits light, and the activation circuit 12 controls the activation of the illumination unit 11.

The illumination unit 11 includes two LED light sources 21 and 22 and a fluorescent body 23. The LED light sources 21 and 22 emit different types of blue light. The fluorescent body 23 covers a light emitting surface of the LED light source 22. Further, the fluorescent body 23 emits yellow light when excited upon absorption of light from the LED light source 22. In the illumination unit 11, the LED light source 21 emits a short wavelength light, and the fluorescent body 23 and the LED light source 22 emit a long wavelength light.

Figure 2:
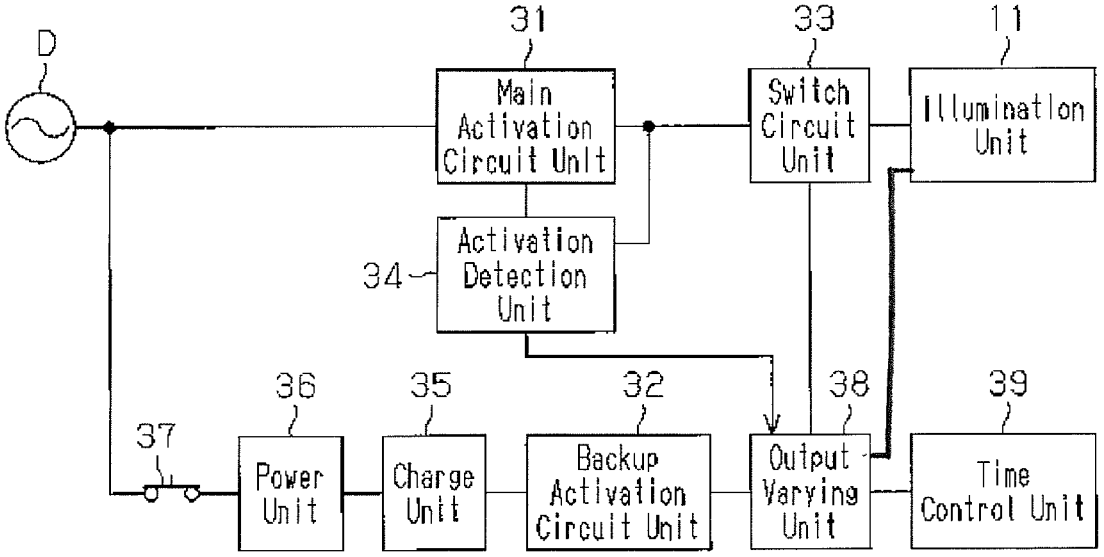
FIG. 2 is a block diagram illustrating the electrical configuration of the lighting device shown in FIG. 1.

As shown in FIG. 2, the activation circuit 12 of the lighting device 10 includes a main activation circuit unit 31, a backup activation circuit unit 32, a switch circuit unit 33, an activation detection unit 34, a charge unit 35, a power unit 36, a switch 37, an output varying unit 38, and a time control unit 39. The main activation circuit unit 31 is electrically connected to an AC power supply D. The switch circuit unit 33 electrically connects the main activation circuit unit 31 to the two LED light sources 21 and 22 of the illumination unit 11. Thus, the two LED light sources 21 and 22 are supplied with power from the AC power supply D through the main activation circuit unit 31 and the switch circuit unit 33. This allows for activation of the two LED light sources 21 and 22. In the present embodiment, the main activation circuit unit 31 and the AC power supply D form a main power supply unit.

The backup activation circuit unit 32 is electrically connected to the charge unit 35. The output varying unit 38 and the switch circuit unit 33 connect the backup activation circuit unit 32 to the LED light source 21 of the illumination unit 11. The charge unit 35 is electrically connected to the power unit 36. The switch 37, which may be turned on and off, electrically connects the power unit 36 to the AC power supply D. When the switch 37 is turned on, the charge unit 35 accumulates power supplied from the AC power supply D through the power unit 36. The LED light source 22 is supplied with power from the charge unit 35 through the backup activation circuit unit 32. This allows for activation of the LED light source 22. In the present embodiment, the backup activation circuit unit 32 and the charge unit 35 form a backup power supply unit.

The activation detection unit 34 detects whether or not power is supplied from the AC power supply D to the main activation circuit unit 31. When the activation detection unit 34 determines that the LED light source 21 is not activated (deactivated) the activation detection unit 34 provides the output varying unit 38 with a varying signal. Upon receipt of the varying signal, the output varying unit 38 controls the switch circuit unit 33 to switch to a power line extending through the backup activation circuit unit 32. More specifically, upon receipt of the varying signal, the output varying unit 38 functions to supply the power from the backup activation circuit unit 32 to the LED light source 21 through the output varying unit 38 and the switch circuit unit 33.

Examples of the operation of the lighting device 10 under normal and abnormal situations will now be described.

Figure 3A:
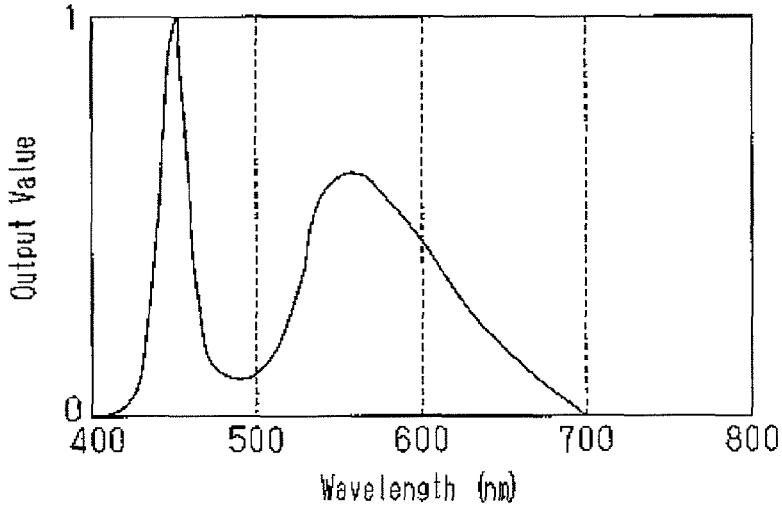
FIGS. 3A and 3B are waveform charts illustrating operation examples of the lighting device shown in FIG. 1.

Under a normal situation, power is supplied from the AC power supply D to the main activation circuit unit 31. The main activation circuit unit 31 controls the activation of the two LED light sources 21 and 22. For example, when an activation operation is performed with an operation switch (not shown), the LED light sources 21 and 22 are activated, and the illumination unit 11 emits white light (refer to FIG. 3A). When the switch 37 is ON, power from the AC power supply D is accumulated in the charge unit 35 through the power unit 36.

Figure 3B:
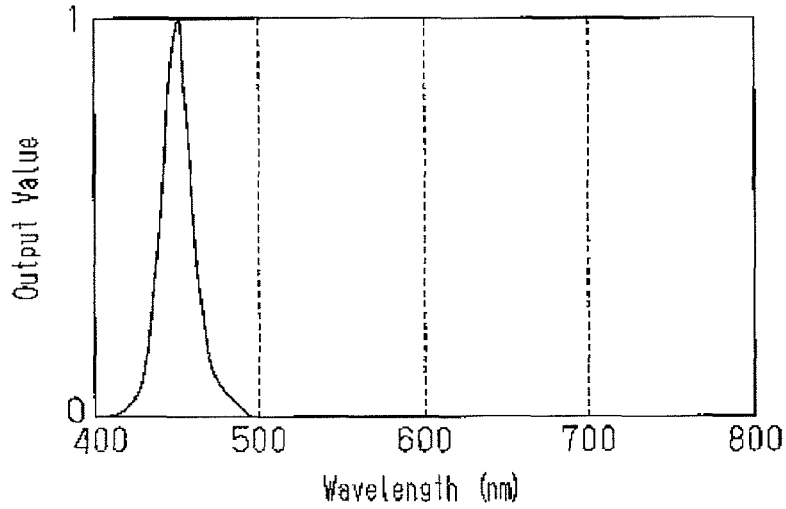

When the supply of power from the AC power supply D is interrupted (abnormal situation) by a wire breakage or the like, the activation detection unit 34 provides the output varying unit 38 with a varying signal. Upon receipt of the varying signal, the output varying unit 38 controls the switch circuit unit 33 to switch to the power line extending through the backup activation circuit unit 32. Thus, the backup activation circuit unit 32 is supplied with power from the charge unit 35 instead of the AC power supply D. Then, for example, when an activation operation is performed with an operation switch (not shown), the LED light source 21 is activated, and the illumination unit 11 emits blue light (refer to FIG. 3B). In this case, the LED light source 22 covered by the yellow fluorescent body 23 is deactivated. This decreases the long wavelength band light output from the LED light source 22 to zero.

The human retina has photoreceptor cells including rods, which function under a mesopic vision situation or a scotopic vision situation. Thus, the activation of the LED light source 21 that emits short wavelength band light (e.g., blue light) improves visibility.

The lighting device 10 of the present embodiment has the advantages described below.

(1) The lighting device 10 includes the illumination unit 11, which includes the two LED light sources 21 and 22, and emit short wavelength band light and long wavelength band light, and the output varying unit 38, which is capable of varying the long wavelength band light output from the illumination unit 11. The output varying unit 38 decreases the output of the LED light source 22 to zero. The LED light source 22 is covered by the fluorescent body 23 that emits the long wavelength band light of the illumination unit 11. Further, the output varying unit 38 activates only the LED light source 21 that emits short wavelength band light. Rods function under a mesopic vision situation or a scotopic vision situation. Thus, the activation of the LED light source 21 that emits short wavelength band light (e.g., blue light) improves visibility. The use of the two LED light sources 21 and 22 as a light source reduces power consumption of the lighting device 10. Further, the number of the LED light sources 21 and 22 is reduced in comparison with the prior art. This, in turn, reduces the number of components of the lighting device 10.

(2) In the lighting device 10, when the power supplied to the illumination unit 11 is switched from the power from the main power supply unit to the power from the backup power supply unit, the activation detection unit 34 provides the output varying unit 38 with a varying signal. Upon receipt of the varying signal, the output varying unit 38 controls the switch circuit unit 33 to decrease the output of long wavelength band light. In this manner, changing the power supply source allows for the output varying unit 38 to decrease the output of long wavelength band light.

It should be apparent to those skilled in the art that the present invention may be embodied in many other specific forms without departing from the spirit or scope of the invention. Particularly, it should be understood that the present invention may be embodied in the following forms.

Although not particularly mentioned above, in the above embodiment, the output varying unit 38 may be configured to gradually decrease the long wavelength band light. This allows for gradual shifting to only the short wavelength band light, and allows for reduction in the time used chromatic adaptation. Thus, a person would not feel discomfort with such a configuration.

Although not particularly mentioned above, in the above embodiment, white light may be emitted until a predetermined time elapses from when the output varying unit 38 is provided with a varying signal by combining short wavelength band light and long wavelength band light, and the output of the long wavelength band light may be decreased after the predetermined time elapses. More specifically, as shown in FIG. 2, the activation circuit 12 includes the time control unit 39 electrically connected to the output varying unit 38. The time control unit 39 measures the elapsed time from when the output varying unit 38 receives the varying signal. The output varying unit 38 controls the switching of the switch circuit unit 33 after the predetermined time elapses based on the measured elapsed time.

Figure 4:
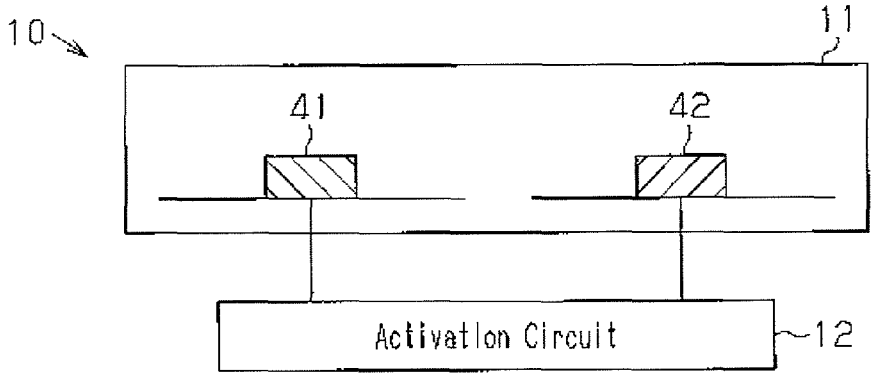
FIG. 4 is a schematic diagram showing a lighting device of a further example.

In the above embodiment, the illumination unit 11 includes the two LED light sources 21 and 22 of substantially the same color (same wavelength band), and the LED light source 22 is covered by the fluorescent body 23 to emit white light. Instead, for example, referring to FIG. 4, an LED light source 41 that emits blue light and an LED light source 42 that emits light in the long wavelength band such as orange color may be used to emit white light by combining long wavelength band light, such as the blue light and the orange light.

Figure 5:
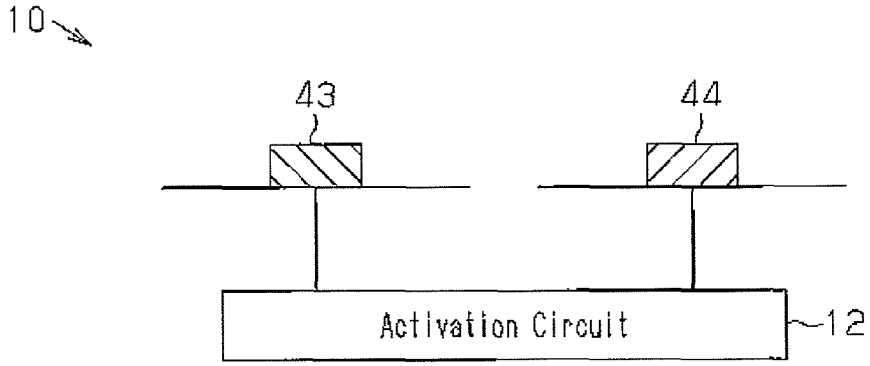
FIG. 5 is a schematic diagram showing a lighting device of a further example.

In the above embodiment, the two LED light sources 21 and 22 are activated during a normal operation. Instead, referring to FIG. 5, the illumination unit 11 may include an LED light source 43 that emits white light and an LED light source 44 that emits blue light. During a normal operation, only the LED light source 43 may be activated to emit white light. During a backup operation, only the LED light source 44 may be activated to emit blue light.

In the above embodiment, during a normal operation and a backup operation, at least one of the LED light sources 21 and 22 is activated. However, there is no such limitation.

Figure 6:
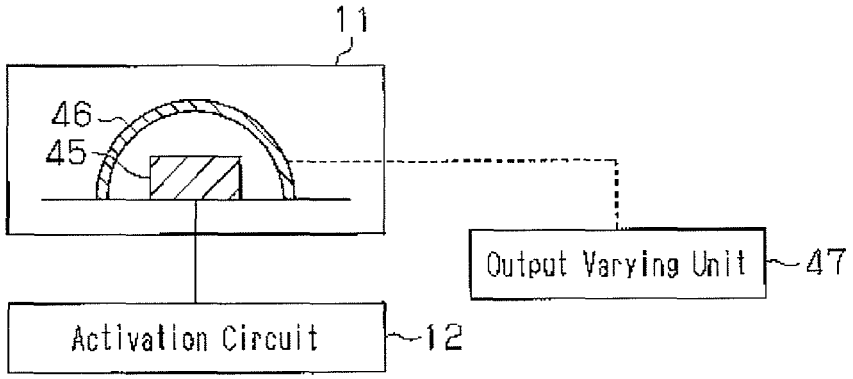
FIG. 6 is a schematic diagram showing a lighting device of a further example.

For example, referring to FIG. 6, the illumination unit 11 may include an LED light source 45 that emits blue light and a fluorescent body 46 that emits blue light and a fluorescent body 46 that emits yellow (orange) light when excited by the light of the LED light source 45. Further, the illumination unit 11 includes an output varying unit 47 that decreases the output of long wavelength band light by cutting or moving the fluorescent body 46 during a backup operation. In this configuration, under a backup operation, the light (blue light) may be emitted from only the LED light source 45. Further, the number of LED light sources 45 may be reduced.

Figure 7:
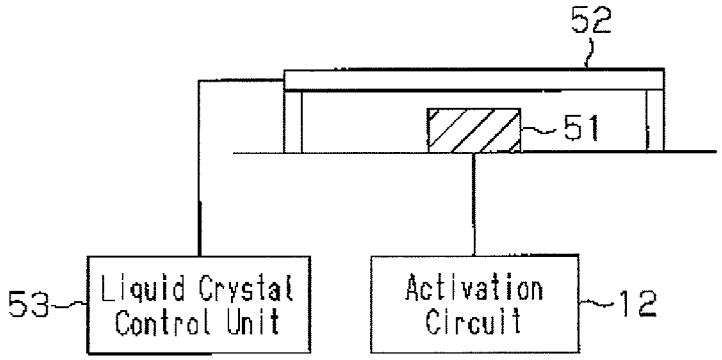
FIG. 7 is a schematic diagram showing a lighting device of a further example.

For example, referring to FIG. 7, the illumination unit 11 may include an LED light source 51 that emits white light, a liquid crystal filter 52 arranged opposing an emission surface of the LED light source 51, and a liquid crystal control unit 53 that controls the liquid crystal filter 52. This allows the liquid crystal control unit 53 to control the liquid crystal filter 52 and emit light having a short wavelength during a backup situation.

Figure 8:
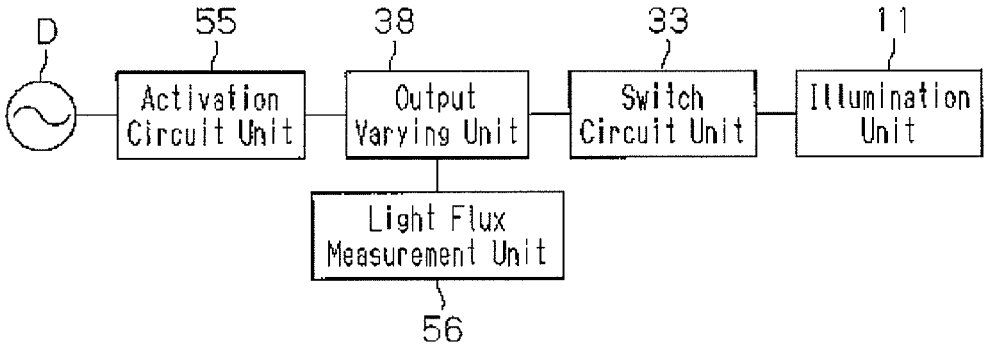
FIG. 8 is a block diagram illustrating the electrical configuration of a lighting device of a further example.

Although not particularly mentioned above, in the above embodiment, for example, referring to FIG. 8, the illumination unit 11 may include a light flux measurement unit 56 that measures the light flux of the two LED light sources 21 and 22. When the light flux of the two LED light sources 21 and 22 measured by the light flux measurement unit 56 becomes less than or equal to a predetermined value, the output varying unit 38 decreases the output of the long wavelength band light. FIG. 8 does not show the backup activation circuit unit 32 and the charge unit 35 that are used during a backup operation.

In the above embodiment, the LED light source 22 emits long wavelength band light, and the fluorescent body 23 and the LED light source 21 emit short wavelength band light. Instead, for example, the illumination unit 11 may include a short wavelength light source unit and a long wavelength light source unit that emits, to the short wavelength light source, short wavelength band light having a relatively small output (spectral intensity) and long wavelength band light having a relatively large output. One such example will now be described.

Figure 9:
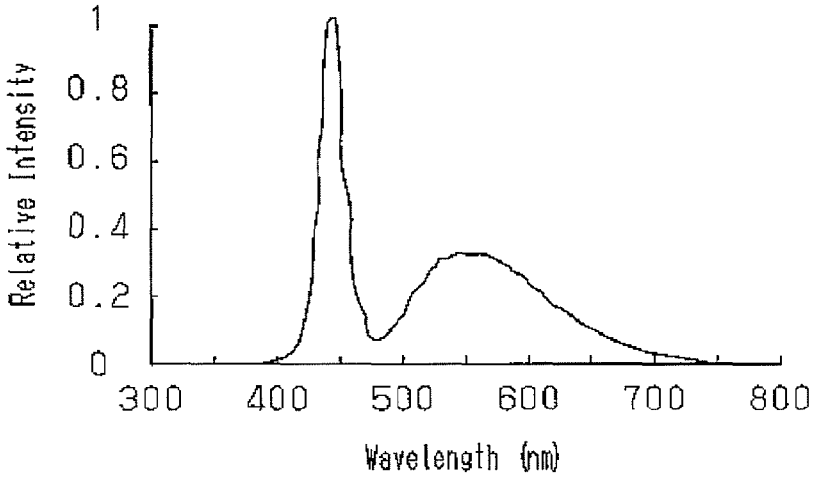
FIG. 9 is a chart of the spectrum from a short wavelength light source in a lighting device of a further example.

The short wavelength light source unit includes, for example, an LED light source and a fluorescent body excited by the light of the LED light source. Referring to FIG. 9, the short wavelength light source unit includes, for example, a first peak wavelength P1 in the proximity of approximately 450 nm and a second peak wavelength P2 in the proximity of approximately 550 nm. When the light output at the first peak wavelength P1 is represented by 1, the short wavelength LED light source is configured so that the light output at the second peak wavelength P2 is approximately 0.3. Further, the short wavelength light source unit is configured so that the correlated color temperature is 10000 K, the average color rendering index Ra is 73, and the S/P ratio is 2.28. The S/P ratio is the ratio of scotopic vision brightness Ls, which is calculated by integrating the spectral luminous efficiency V' (λ) under scotopic vision and the spectral characteristics of a lamp, and the photopic vision brightness Lp, which is calculated by the spectral luminous efficiency V (λ) under photopic vision and the spectral characteristics of a lamp.

The long wavelength light source unit includes, for example, an LED light source and a fluorescent body excited by the light of the LED light source. The long wavelength light source unit emits light of a short wavelength band having a relatively small light output and light of a long wavelength band having a relatively large light output to the short wavelength light source unit. For example, the long wavelength light source unit emits light including spectrum A, shown by the solid line in FIG. 10, and spectrum B, shown by the broken line in FIG. 10. The spectrum A of the long wavelength light source unit has a first peak wavelength P1 in the proximity of approximately 455 nm, a second peak wavelength P2 in the proximity of approximately 490 nm, and a third peak wavelength P3 in the proximity of approximately 600 nm. When the light output at the first peak wavelength P1 is represented by 1, the long wavelength light source unit that emits the spectrum A is configured so that the light output at the second peak wavelength P2 is approximately 0.9 and the light output at the third peak wavelength P3 is approximately 0.53. Further, the long wavelength light source unit that emits the spectrum A is configured so that the correlated color temperature is 6800 K, the average color rendering index Ra is 85, and the S/P ratio is 2.79.

Figure 11:
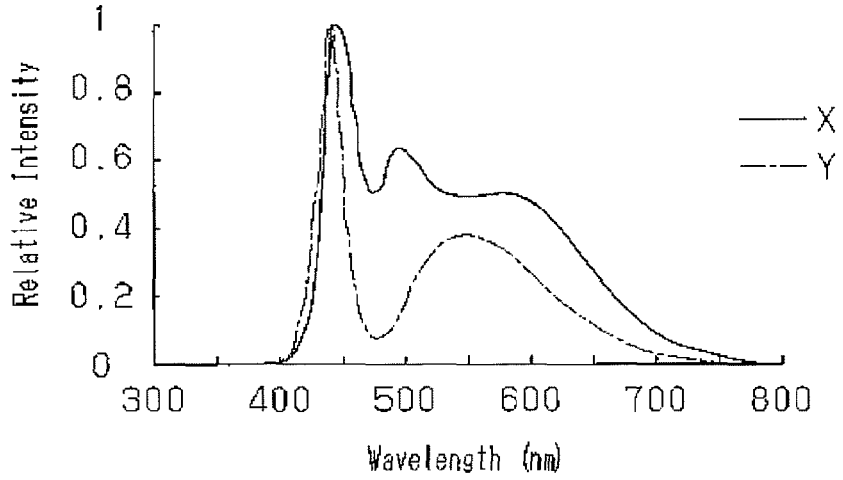
FIG. 11 is a chart of the spectrum of synthesized light from short and long wavelength light source units in a lighting device of a further example.

In FIG. 11, spectrum X shown by the solid line indicates the spectrum of synthesized light when activating the short wavelength light source unit and the long wavelength light source emitting the spectrum A. In this case, the synthesized light has a correlated color temperature of 8000 K, an average color rendering index Ra of 95, and an S/P ratio of 2.62.

Figure 10:
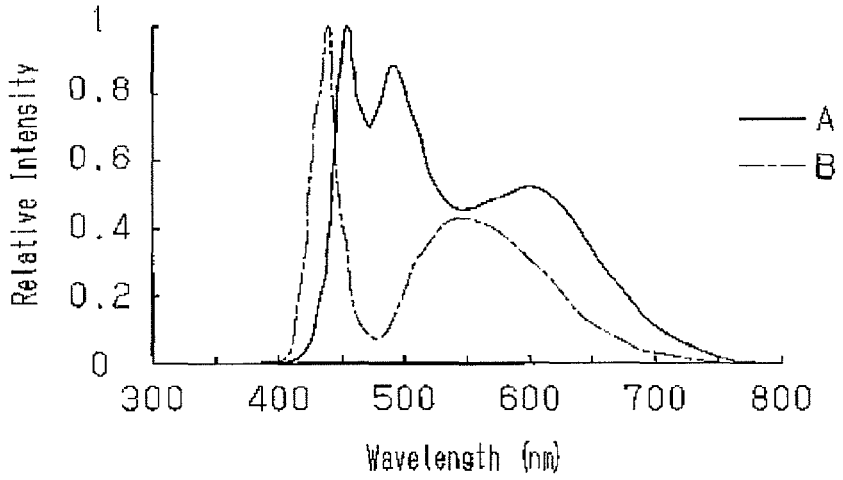
FIG. 10 is a chart of the spectrum from a long wavelength light source unit in a lighting device of a further example.

Further, the long wavelength light source unit that emits the spectrum B, shown by the broken line in FIG. 10, has a first peak wavelength P1 in the proximity of approximately 440 nm and a second peak wavelength P2 in the proximity of approximately 550 nm. When the light output at the first peak wavelength P1 is represented by 1, the long wavelength light source unit that emits the spectrum B is configured so that the light output at the second peak wavelength P2 is approximately 0.43. Further, the long wavelength light source unit that emits the spectrum B is configured so that the correlated color temperature is 7100 K, the average color rendering index Ra is 70, and the S/P ratio is 2.04.

In FIG. 11, spectrum Y shown by the broken line indicates the spectrum of synthesized light when activating the short wavelength light source unit and the long wavelength light source emitting the spectrum B. In this case, the synthesized light has a correlated color temperature of 8100 K, an average color rendering index Ra of 71, and an S/P ratio of 2.14.

In the lighting device configured in this manner, as shown in FIG. 2, the activation detection unit 34 detects whether or not the main activation circuit unit 31 is supplied with power from the AC power supply D. When the main activation circuit unit 31 is supplied with power during a normal operation, the main activation circuit unit 31 controls the activation of the short and long wavelength light source units in the illumination unit 11. For example, when an activation operation is performed with an operation switch (not shown), the short and long wavelength light source units are activated so that the illumination unit 11 emits white light (refer to FIG. 11).

When the supply of power from the AC power supply D is interrupted due to a wire breakage or the like, the activation detection unit 34 provides the output varying unit 38 with a varying signal. Upon receipt of the varying signal, the output varying unit 38 controls the switch circuit unit 33 to switch to the power line extending through the backup activation circuit unit 32. This supplies the backup activation circuit unit 32 with power from the charge unit 35 instead of the AC power supply D. Then, for example, when an activation operation is performed with an operation switch (not shown), only the short wavelength light source unit is activated, and the illumination unit 11 emits light having a correlated color temperature of 10000 K (refer to FIG. 9).

Light having a correlated color temperature of 10000 K is in a correlated color temperature range (2500 K to 10000 K) used as an LED module for emitting white light as specified in JIS C8155:2010 "General Lighting LED Module, Capacity Requirements". Thus, white light may be emitted during a backup operation. Further, when the long wavelength light source unit is deactivated, only the short wavelength light source unit having a relatively high color temperature is activated. As a result, the S/P ratio during the backup operation is higher than that during a normal operation. Further, the light from the short wavelength light source unit, as a single body, has an average color rendering index Ra of 70 or greater. Thus, sufficiently high color rendering may be maintained.

Figure 12:
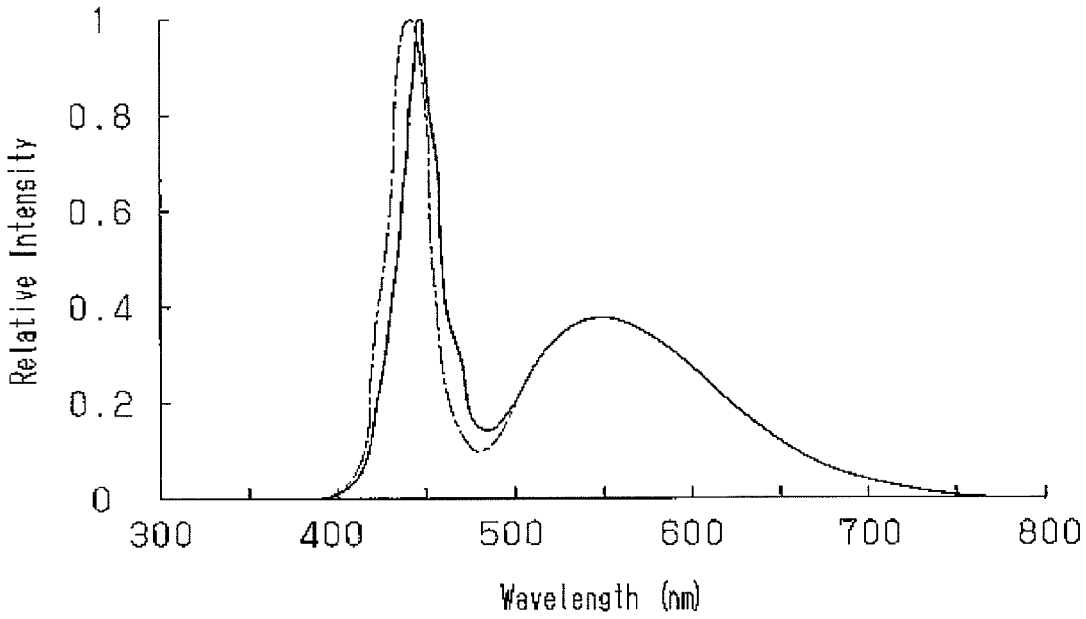
FIG. 12 is a chart of the spectrum from a short wavelength light source unit in a lighting device of a further example.

The short wavelength light source unit and the long wavelength light source unit of the above modified examples are activated with the same light flux during normal operation. However, the light flux ratio may be varied. Further, in the above modified examples, the long wavelength light source unit is activated. Instead, the long wavelength light source unit may be dimmed. In this manner, the long wavelength light source unit may be activated or dimmed so that in the light output of the light emitted from the illumination unit 11, the light output of the long wavelength band is greater than the light output of the short wavelength band. The short wavelength light source unit does not have to have the characteristics shown in FIG. 9 and may have the characteristics shown by the solid line or broken line in FIG. 12.

In the above embodiment, when receiving the varying signal, the output varying unit 38 supplies power from the backup activation circuit unit 32 to the LED light source 21 through the output varying unit 38 and the switch circuit unit 33. Instead, when receiving the varying signal, the output varying unit 38 may supply power from the backup activation circuit unit 32 through only the switch circuit unit 33. In this case, the activation detection unit 34 may provide the varying signal to the switch circuit unit 33 so that the switch circuit unit 33 switches to a power line extending through the backup activation circuit unit 32.

The present examples and embodiments are to be considered as illustrative and not restrictive, and the invention is not to be limited to the details given herein, but may be modified within the scope and equivalence of the appended claims.

The invention claimed is:

1. A lighting device comprising:

an illumination unit including two or less LED light sources, wherein the illumination unit uses the two or less LED light sources to emit light of a short wavelength band and light of a long wavelength band; and an output varying unit that functions to vary an output of at least the long wavelength band light, wherein when the output varying unit receives a varying signal, the output varying unit functions to decrease the output of at least the long wavelength band light, wherein the lighting device further comprises:

a main power supply unit that supplies power to the illumination unit; and a backup power supply unit that supplies power to the illumination unit during a backup situation in which the supply of power from the main power supply unit is interrupted, wherein the output varying unit receives the varying signal indicating that the power supplied to the illumination unit has been switched from the power supplied by the main power supply unit to the power supplied by the backup power supply unit, and the output varying unit functions to decrease the output of at least the long wavelength band light when receiving the varying signal.

2. The lighting device according to claim 1, wherein the output varying unit gradually decreases the output of at least the long wavelength band light.

3. The lighting device according to claim 1, wherein the illumination unit emits white light by emitting the short wavelength band light and the long wavelength band light; and the output varying unit combines the short wavelength band light and the long wavelength band light to emit the white light until a predetermined time elapses from when receiving the varying signal, and the output varying unit decreases the output of at least the long wavelength band light after the predetermined time elapses.

4. The lighting device according to claim 1, further comprising:

a main power supply unit that supplies power to the illumination unit; and a detection unit that provides the output varying unit with the varying signal when detecting that the supply of power from the main power supply unit has been interrupted.

5. The lighting device according to claim 4, further comprising a backup power supply unit that supplies power to the illumination unit during a backup situation in which the supply of power from the main power supply unit is interrupted, wherein when the output varying unit receives the varying signal, the output varying unit switches the power supplied to the illumination unit from the power supplied by the main power supply unit to the power supplied by the backup power supply unit.

* * * * *